United States Patent [19]

Kielmeyer

[11] Patent Number: 4,756,957

[45] Date of Patent: Jul. 12, 1988

[54] LOOSE-FILL INSULATION

[75] Inventor: William H. Kielmeyer, Englewood, Colo.

[73] Assignee: Manville Corporation, Denver, Colo.

[21] Appl. No.: 422,067

[22] Filed: Sep. 23, 1982

Related U.S. Application Data

[63] Continuation of Ser. No. 84,694, Oct. 15, 1979, Pat. No. 4,366,927, which is a continuation of Ser. No. 834,616, Sep. 19, 1977, abandoned.

[51] Int. Cl.[4] ..... D04H 1/58

[52] U.S. Cl. ..... 428/288; 65/44; 156/167; 156/181; 156/250; 156/254; 156/344; 264/118; 264/128; 428/283; 428/402; 428/426; 428/542.8; 241/4

[58] Field of Search ..... 428/542.8, 288, 283, 428/402, 426; 65/4.4; 156/167, 181, 250, 254, 344; 264/118, 128; 241/4

[56] References Cited

U.S. PATENT DOCUMENTS

| | | | |
|---|---|---|---|
| 2,219,285 | 10/1940 | Allen et al. | 156/62.4 |
| 2,233,433 | 3/1941 | Smith | 428/392 |
| 2,579,035 | 12/1951 | Edelman | 252/62 |
| 2,618,817 | 11/1952 | Slayter | 19/161 |
| 3,584,796 | 6/1971 | Earle et al. | 241/4 |
| 3,736,215 | 5/1973 | Felder et al. | 156/271 |
| 3,932,161 | 1/1976 | McNish | 65/4 R |
| 4,296,164 | 10/1981 | Bemis et al. | 428/219 |
| 4,366,927 | 1/1983 | Kielmeyer | 428/171 |

*Primary Examiner*—James J. Bell

*Attorney, Agent, or Firm*—John D. Lister; Cornelius P. Quinn

[57] ABSTRACT

An insulation suitable for application to building spaces by pneumatic devices comprising a multitude of small pieces of low density fibrous material, the fibrous pieces being uniformly sized and having a hexahedral configuration.

2 Claims, 1 Drawing Sheet

LOOSE-FILL INSULATION

This is a continuation of application Ser. No. 084,694 filed Oct. 15, 1979 now U.S. Pat. No. 4,366,927 which is a continuation of Ser. No. 834,616 filed Sept. 19, 1977 now abandoned.

BACKGROUND OF THE INVENTION

This invention relates to a loose-fill insulation that consists of regularly shaped and uniformly sized pieces of bonded glass fibers that can be pneumatically applied over horizontal building surfaces.

The use of fiber glass blowing wool or loose-fill insulation is well known and is preferred by many contractors because it can be easily and quickly applied to new and old buildings and is a relatively low cost material.

Conventionally, blowing wool is produced from bonded glass fibers which is crushed or pulverized into small sized pieces by a hammer mill. One known process for producing blowing wool is disclosed in U.S. Pat. No. 3,584,796, wherein bonded glass fiber material having a density in the range of about 0.2 to 20 per cubic foot, is fed into a hopper in which is located a rotary cutter which severs the material into small pieces. The severed material is removed from the cutting area by suction through a sizing screen. Blowing wool produced by these methods is characterized by constituent pieces or nodules that have no uniformity in size, nor regularity in configuration, which results in the tendency of the non-regular nodules to bridge together within some regions of an installed blanket creating excessive voids, and to clump together in other regions. This non-uniform distribution gives forth to non-uniform thermal performance or R values across the insulating blanket.

BRIEF SUMMARY OF THE INVENTION

It is an object of the invention to provide a loose-fill insulation of a fibrous material that has improved coverage per unit of weight at a given R value. It is another object of the invention to provide a loose-fill insulation having constituent pieces that are more uniformly distributed throughout the space in which the insulation is deposited to provide a loose-fill insulation having greater uniformity of thermal performance.

Accordingly the present invention provides a thermal insulation, suitable for application in building spaces by pneumatic means, characterized by a multitude of small, uniformly sized, low density pieces of bonded fibers, said fibrous pieces having a generally hexahedral configuration. It has been found that the above objects may be attained by providing a loose-fill insulation comprising generally hexahedrally shaped and uniformly sized pieces of fibrous material which in the preferred embodiment of the invention comprises resin bonded glass fibers. A section of a cured fibrous mat having the density, fiber size, anti-dust oil and binder content desired in the finished product is compressed in the direction of its thickness. The compressed section is then cut both longitudinally and laterally to provide smaller pieces having a uniform length and width. Released of compression, these pieces spring back to attain a thickness approaching that of the uncompressed section. Agitation of these intermediate fibrous pieces causes them to immediately delaminate in the direction of their thickness, resulting in a finished product of pieces having uniform length and width and a slightly varying thickness.

DETAILED DESCRIPTION OF THE INVENTION

Figure 1:
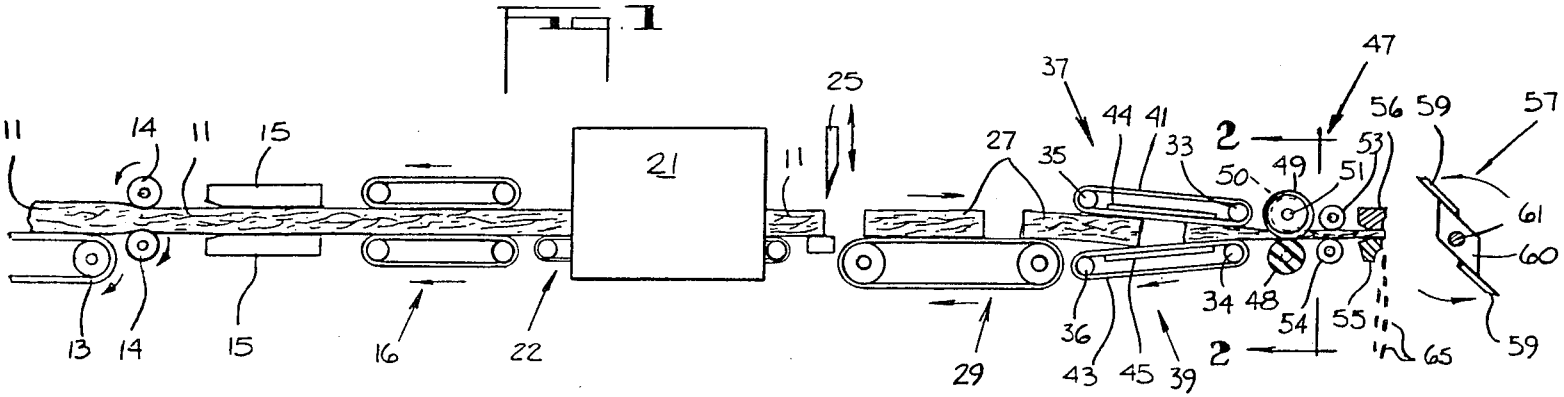
FIG. 1 is a schematic side view illustrating the method of the present invention.
Figure 2:
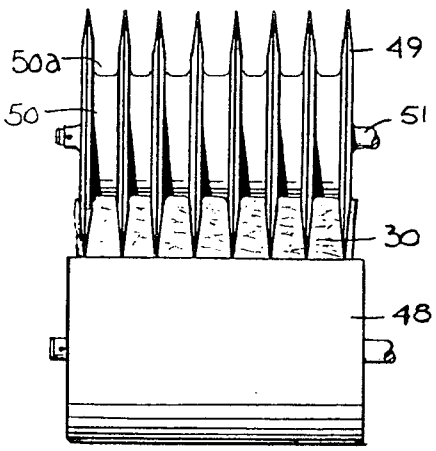
FIG. 2 is an enlarged end view taken along lines 2—2 in FIG. 1.

To produce the blowing wool of the invention a relatively loose, low density mat or blanket 11 of glass fibers, impregnated with a suitable binder such as a melamine or phenol formaldehyde resin, is fed from a collection chamber or other source and drawn in continuous movement through a pair of heated and free rotating rollers 14. The heated rollers 14 partially cure and compress the loose fibrous blanket 11 and impart some degree of dimensional stability to the fibrous mass at this stage of the process. The blanket 11 then passes through a set of heated spaced apart platens 15. The blanket 11 slidably engages the smooth inner surfaces of platens 15 which shape the fibrous blanket to the desired thickness and configuration and cures the binder on the surfaces of the blanket sufficiently to maintain that thickness and configuration. While platen assemblies similar to those disclosed in U.S. Pat. No. 3,583,030 to Terry et al are preferred, it is to be understood that other types of curing assemblies can be substituted for assemblies 15. After the blanket exits platens 15, it passes through a pair of endless pull-through conveyors 16 or other pull-through apparatus for applying the force to pull the blanket through the heated platens 15. Blanket 11 is then delivered to oven conveyor 22 which carries the blanket through the curing oven 21. Upon exit from oven 21 the resin binder has been cured and set. At this stage of the process the cured blanket has a density ranging from 0.4 $lb/ft^3$ to 1.0 $lb/ft^3$ but preferably the density limits are 0.4 $lb/ft^3$ to 0.6 $lb/ft^3$. Binder, preferably phenol formaldehyde containing 20% or less of urea should represent 3.0 to 5.0% by weight of the blanket material. An additional 0.5 to 1% by weight should comprise a suitable anti-dust oil such as TUFFLO-80 by Atlantic Richfield. The fiber diameters are from 3.5 to 6.0 microns, preferably from 4.0 to 4.5 microns.

The shaped and cured blanket 11, advancing out of the oven 21 onto take-off conveyor 29, is chopped into segments 27 of a predetermined length by action of vertically reciprocating chopper blade 25. Take-off conveyor 29 operates at a sufficiently higher line speed than oven conveyor 22 so as to create a spacing between advancing segments 27.

At the terminal end of conveyor 29 are spaced apart compacting conveyors 37 and 39. These conveyors include endless conveyor belts 41 and 43 which are trained about drive rolls 33 and 34 and idler rolls 35 and 36. Conveyor belts 41 and 43 run at the same speed, with the lower run of the upper conveyor belt and the upper run of the lower conveyor belt moving in the same direction toward the slitter assembly 47. The speed of conveyor belts 41 and 43 is greater than the line speed of conveyor 29. The conveyors 37 and 39 are each provided with backing plates 44 and 45 which back up the opposing runs of conveyor belts 41 and 45. As noted from FIG. 1 the lower run of the conveyor belt 41 and the upper run of the conveyor belt 43 converge toward each other in the direction of travel of the belts 41 and 43 so as to reduce the thickness of each section 27. An inclination for each of the conveyor belts of about 5° to the horizontal has been found to be satisfactory although this angle can vary.

Next to the converging ends of conveyors 37 and 39 is located a slitter blade assembly 47 which comprises a plurality of spaced apart disc blades 49 mounted for driven rotation on shaft 51 which extends transversely of the direction of motion of conveyors 37 and 39. These blades are spaced apart at equal distances by spacers 50. A plurality of cylindrical surfaces **50*a* of equal diameter is provided between blades 49 by spacers 50. Below slitter assembly 47 is backup roll 48 which is driven in counter-rotation to slitter blades 49. The cylindrical surfaces 50*a* are spaced from the surface of the backup roll 48 at a distance to maintain each segment 27 in its compressed thickness. The peripheral speed of blade 49 matches the peripheral speed of backup roll 48 and the cutting edges of blades 49 engage the rolling surface of backup roll 48. As shown in FIG. 1, spaced apart feed rolls 53 and 54 are positioned adjacent the slitter blade assembly 47 and are driven in counter-rotation at matching peripheral speeds. Conveyor belts 41 and 43, slitter blades 49 and backup roll 48, and feed rolls 53 and 54 run at matching peripheral speeds. As the segments 27 pass through the slitters 47 they are cut into strips 30. A stationary cutting bed 55 is adjacent the nip of rollers 53 and 54, and a guide plate 56 having a smooth surface opposing the upper face of cutting bed 55 is located thereabove. The cutting bed 55 and the guide plate 56 function to maintain the strips 30 in compressed condition. Next to the stationary cutting bed 55 is located a rotary cutter 57, of a conventional design, which comprises a support member 60 mounted on an axle 61 and carrying at spaced points on its periphery cutting blades 59. These blades 59 have cutting edges which cooperate with an edge of stationary cutting bed 55. The rotating blades and the stationary bed extend in a direction parallel to the axel 61**.

Cured blanket segment 27 is delivered by the takeoff conveyor 29 into the diverging end of compression conveyors 37 and 39. The vertical spacing between conveyor belts 41 and 43 at this end of the conveyors is greater than the thickness of the segment 27 in order to facilitate entry of segment 27 into the grasping nip of compression conveyors 37 and 39. Segment 27 is carried towards the converging ends of conveyors 37 and 39 and is gradually compressed between the opposing runs of conveyor belts 41 and 43. Backing plates 44 and 45 lend the needed support to the conveyor belts during this operation. Segment 27 is compressed to a substantial degree, e.g., an 8" thick segment is compressed to a thickness of about ½". Segment 27, in its compressed form, is delivered into the nip of counter-rotating slitter blades 49 and backup roll 48 and sliced completely through into a plurality of strips 30, each strip having a width defined by the spacing of the slitter blades 49, a length corresponding to the length of the segment 27 and a thickness at least equal to the compressed thickness of segment 27. During the slitting operation the cylindrical surfaces **50*a* presented by the blade spacers 50 cooperate with the backup roll 48 in maintaining the segment 27 in a compressed state. Moving further to the right as shown in FIG. 1, the plurality of compressed strips 30 are engaged by rotary cutter feed rolls 53 and 54 which feed the strips 30 at a constant speed over the stationary bed 55. A lower surface of guide plate 56 slidably engages the top surfaces of compressed strips 30 and maintains their compressed state. Leading portions of the advancing strips are engaged by downwardly moving cutting edges of rotary blades 59** which on each sweep make a generally vertical cut through the strips in a plane generally perpendicular to the direction of strip lengths.

Figure 3:
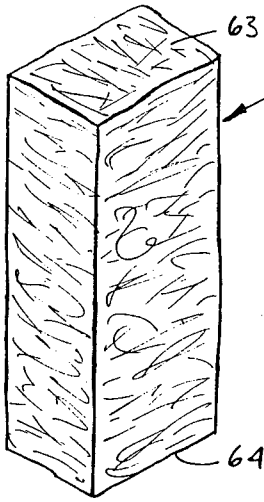
FIG. 3 is a view in perspective of an intermediate fibrous column of bonded glass fibers prior to delamination.
Figure 4:
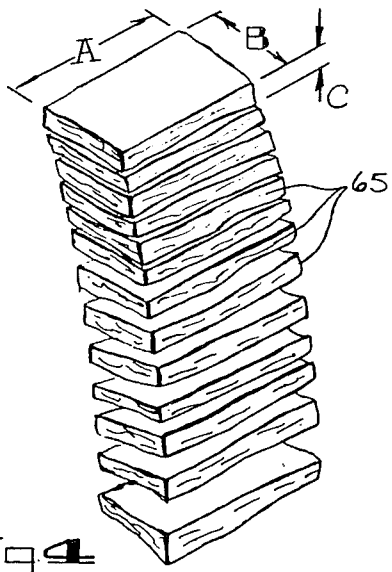
FIG. 4 is a view in perspective illustrating the delamination of the fibrous column of FIG. 3 into the small pieces of insulation according to the invention.

For an instant following each stroke of cutting blades 59 the compressed fibrous material springs back substantially to its original thickness to provide a plurality of columns 62 of fibrous material, one column 62 being illustrated in FIG. 3, having a width corresponding to the spacing of slitter blades 49 and a length determined by the feed speed of the material and the rotational speed of the rotary cutter 57 and a thickness approaching the original thickness of segment 27. Because of the relatively low structural integrity in the direction parallel to the upper and lower surfaces 63 and 64 of column 62, the agitation the material experiences as it passes through the cutter and subsequent transfer duct work, the columnar bodies will begin to delaminate in planes generally parallel to the upper and lower surfaces 63 and 64 of each column 62 immediately after leaving the rotary cutter. There results numerous small pieces 65 of insulation that comprise the finished product. These pieces are then pneumatically conveyed via duct work to a cyclone where excess dust is removed and then to a bagger station for final packaging.

FIG. 3 illustrates the delamination of a fibrous column into individual blowing wool pieces 65 having a hexahedral configuration, with letters A, B, and C representing respectively the width, length and thickness of a piece. The definite rectangular configuration shown in the plane of the length and width, being predetermined by making the appropriate slitting and cutting settings, is characteristic of all pieces produced on any given production run of the previously described production process; additionally these rectangular dimensions are uniformly provided in all pieces thus produced. It is desirable that length and width of pieces be maintained in the range of ¼" to 1". From the standpoint of thermal performance it is most preferable that length of pieces fall in the range of ¼" to ⅝" and width in the range of ⅜" to ¾". The third dimension, representing the thickness of the piece, is the least controllable dimension and generally tends to vary between 1/32" and ¼", depending on the amount of jostling the piece receives as it passes through the cutter, transfer duct work, cyclone, and bagger.

These novel insulation pieces are applied by suitable blowing apparatus generally over horizontally extending surfaces such as attic floors, until a predetermined depth is reached which corresponds to the desired degree of thermal insulation. With this regular and uniformly sized product a greater coverage than achievable with conventional loose-fill insulation results for a given weight of material at a given R value. In addition, these novel insulation pieces will lay into a uniformly distributed blanket having a thermal performance which is uniformly distributed over the insulated surface.

I claim:

1. Blowing insulation comprising columns each having a maximum dimension several times greater than either of two other dimensions measured at right angles to the maximum dimension, the columns having been cut from a generally laminated blanket of bonded glass fibers in such a manner that the maximum dimension of each column initially extends in the direction of a minimum dimension or thickness of the blanket, and being subject, due to their generally laminated structure, to breaking up at random into fibrous glass prisms, approximate cubes, and flakes of various thicknesses upon being handled after they are cut from the blanket.

2. Blowing insulation comprising fibrous glass prisms, approximate cubes, and flakes of various thicknesses formed upon the handling of the columns as claimed in claim 1.

* * * * *